US009149915B1

(12) United States Patent
Sparks

(10) Patent No.: US 9,149,915 B1
(45) Date of Patent: Oct. 6, 2015

(54) WRENCH

(71) Applicant: The Boeing Company, Chicago, IL (US)

(72) Inventor: Rick E. Sparks, Stanwood, WA (US)

(73) Assignee: THE BOEING COMPANY, Chicago, IL (US)

( * ) Notice: Subject to any disclaimer, the term of this patent is extended or adjusted under 35 U.S.C. 154(b) by 223 days.

(21) Appl. No.: 13/740,514

(22) Filed: Jan. 14, 2013

(51) Int. Cl.
*B25B 13/08* (2006.01)

(52) U.S. Cl.
CPC ..... *B25B 13/08* (2013.01)

(58) Field of Classification Search
CPC ..... B25B 13/08
USPC ..... 81/176.1, 125.1, 119, 186, 489; D8/21, D8/27, 105
See application file for complete search history.

(56) References Cited

U.S. PATENT DOCUMENTS

| | | | | | |
|---|---|---|---|---|---|
| 825,401 | A * | 7/1906 | Merckens | 81/120 |
| 828,859 | A * | 8/1906 | Merckens | 408/231 |
| 914,199 | A * | 3/1909 | Stiren | 7/138 |
| 983,796 | A * | 2/1911 | Allen | 7/142 |
| 1,072,479 | A * | 9/1913 | Martindale | 81/124.3 |
| 1,256,216 | A * | 2/1918 | Fessler | 81/177.85 |
| 1,326,387 | A * | 12/1919 | Bowen | 81/92 |
| 1,529,075 | A * | 3/1925 | McIntyre | 81/124.3 |
| 1,802,832 | A * | 4/1931 | Priddle | 81/125.1 |
| D142,263 | S * | 8/1945 | Pierre | D8/26 |
| 2,426,763 | A * | 9/1947 | Curtis | 81/125.1 |
| D176,005 | S * | 11/1955 | Cariello | D8/17 |
| 7,146,884 | B2 * | 12/2006 | Chaconas et al. | 81/119 |
| D596,011 | S * | 7/2009 | Almayda | D8/105 |
| 7,874,034 | B1 * | 1/2011 | Mack et al. | 7/138 |
| 7,926,392 | B2 * | 4/2011 | Thompson | 81/119 |
| 2007/0283789 | A1 * | 12/2007 | Zeidler | 81/125.1 |
| 2008/0216619 | A1 * | 9/2008 | Brackbill et al. | 81/463 |

OTHER PUBLICATIONS

Vernon Nail Antique Wrench Auction Pictures—Apr. 2007—York, NE; retrieved from the Internet Jan. 10, 2013: http://home.southwind.net/~donhaury/nail-auction-2007/all-pics.html; (138 pgs).

thumbscrew_wrenches.jpg (JPEG Image, 489×351 pixels); retrieved from the Internet Jan. 10, 2013: http://home.comcast.net/~kvaughn65/thumbscrew_wrenches.jpg; (1 pg).

* cited by examiner

*Primary Examiner* — David B Thomas
(74) *Attorney, Agent, or Firm* — Toler Law Group, PC

(57) ABSTRACT

A wrench has an S-shaped body with a first end, a second end, a first slot, and a second slot. A virtual ground plane is substantially perpendicular to walls of the slots. A first virtual reference plane is perpendicular to the virtual ground plane and abuts the S-shaped body at first and second points on a first side. A second virtual reference plane is perpendicular to the first virtual reference plane and to the virtual ground plane and abuts the S-shaped body at a third point proximate the first end. A third virtual reference plane is perpendicular to the first virtual reference plane and to the virtual ground plane and abuts the S-shaped body at a fourth point proximate the second end. A fourth virtual reference plane is perpendicular to the virtual ground plane and abuts the S-shaped body at fifth and sixth points on a second side.

20 Claims, 3 Drawing Sheets

WRENCH

FIELD OF THE DISCLOSURE

The present disclosure is generally related to a wrench.

BACKGROUND

Certain fasteners are designed for use with a corresponding purpose-built (as opposed to general-purpose) tool. For example, hex head fasteners (e.g., hex head bolts, hex nuts, hex head screws, hose clamps with hex head worm drives) may have a hexagonally shaped head that mates with a wrench having a corresponding size and shape. However, other fasteners are commonly tightened or loosened without tools or without purpose-built tools. For example, a fastener may have a head designed for gripping by hand or between a user's thumb and forefinger (e.g., a wing nut, a thumb screw, a hose clamp with thumb screw worm drive), referred to herein as "hand-tightened fasteners". Heads of hand-tightened fasteners are generally designed to provide adequate torque while maintaining user comfort. For example, the head of a hand-tightened fastener may be relatively broad and flat or knurled.

Although hand-tightened fasteners may be tightened at least partially by hand, some may also need to be tightened using general-purpose tools (such as pliers). For example, in a particular application, a hand-tightened fastener may be specified to be hand-tightened and then further tightened a specified number of turns. When the hand-tightened fastener is in a hard to reach area or is visually obscured, it may be difficult for the user to apply a general-purpose tool (e.g., pliers) to perform the further tightening due, for example, to work space constraints or difficulty with mating the general-purpose tool to a head of the hand-tightened fastener. Moreover, additional effort by the operator may be required to maintain the grip of the general-purpose tool, such as pliers, on the fastener, possibly resulting in operator fatigue and/or inadequate tightening or the inability to loosen the fastener.

SUMMARY

A wrench is disclosed that enables the desired tightening or loosening of a fastener, such as a hand-tightened fastener, in a limited work space. A body of the wrench may include slots that promote positive engagement with the fastener without the need for the operator to exert additional effort to maintain such engagement. The slots are arranged to simplify the use of the wrench, especially when the available work space does not provide the operator with a line of sight to the wrench and/or the fastener (i.e., when the wrench and/or the fastener are visually inaccessible). For example, the slots may be formed along the body of the wrench and the body of the wrench may be shaped such that the slots are easily located by the operator, even when they are not visible, through the sense of touch. Moreover, the slots may be tapered such that a mouth of each slot is wider than a base thereof, facilitating engagement with the fastener. The body of the wrench may be shaped and the slots configured therein such that the wrench can be flipped, rotated, or reversed to deliver improved access to the fastener in areas with limited access. The body of the wrench may also be shaped to reduce operator discomfort during use.

In a particular example, a wrench includes an S-shaped body having a first end, a second end, a first slot proximate the first end, and a second slot proximate the second end. Each of the first slot and the second slot has a length, a largest width, and a smallest width, and the length is larger than the largest width. The S-shaped body is shaped such that a virtual ground plane is substantially perpendicular to walls of the first slot and the second slot of the S-shaped body. A first virtual reference plane is perpendicular to the virtual ground plane and abuts the S-shaped body at a first point and a second point on a first side of the S-shaped body. The first point and the second point are between the first slot and the second slot. A second virtual reference plane is perpendicular to the first virtual reference plane and to the virtual ground plane and abuts the S-shaped body at a third point proximate the first end. A third virtual reference plane is perpendicular to the first virtual reference plane and to the virtual ground plane and abuts the S-shaped body at a fourth point proximate the second end. A fourth virtual reference plane is perpendicular to the virtual ground plane and abuts the S-shaped body at a fifth point and a sixth point on a second side of the S-shaped body. The fifth point and the sixth point are between the first slot and the second slot, and the second side is opposite the first side.

In another particular example, a wrench includes an S-shaped body having a first end, a second end, a first slot proximate the first end, and a second slot proximate the second end. The first slot may be of substantially equal size and shape to the second slot. The shape of each slot may have a largest width at a mouth end and smallest width at a base end. The S-shaped body is shaped such that a virtual ground plane is substantially perpendicular to walls of the first slot and the second slot of the S-shaped body. A first virtual reference plane is perpendicular to the virtual ground plane and abuts the S-shaped body at a first point and a second point on a first side of the S-shaped body. The first point and the second point are between the first slot and the second slot. A second virtual reference plane is perpendicular to the first virtual reference plane and to the virtual ground plane and abuts the S-shaped body at a third point proximate the first end. A third virtual reference plane is perpendicular to the first virtual reference plane and to the virtual ground plane and abuts the S-shaped body at a fourth point proximate the second end. A fourth virtual reference plane is perpendicular to the virtual ground plane and abuts the S-shaped body at a fifth point and a sixth point on a second side of the S-shaped body. The fifth point and the sixth point are between the first slot and the second slot, and the second side is opposite the first side. A first dimension of the wrench corresponds to a shortest distance between the second virtual reference plane and the third virtual reference plane. A second dimension of the wrench corresponds to a distance between the first virtual reference plane and the fourth virtual reference plane measured midway between the second virtual reference plane and the third virtual reference plane. A ratio of the first dimension divided by the second dimension has a value less than 3.

In another particular example, a wrench includes an S-shaped body including a first end, a second end, a first slot proximate the first end, a second slot proximate the second end, and a third slot on a side of the S-shaped body between the first end and the second end. The S-shaped body is shaped such that a virtual ground plane is substantially perpendicular to walls of the first slot, the second slot, and the third slot. A ratio of a perimeter (where, at each slot, the perimeter is measured across a mouth of the slot) a projection of the S-shaped body on the virtual ground plane divided by a sum of a largest widths of the slots is greater than 11.

The features, functions, and advantages that have been described can be achieved independently in various embodiments or may be combined in yet other embodiments, further details of which are disclosed with reference to the following description and drawings.

DETAILED DESCRIPTION

Figure 1:
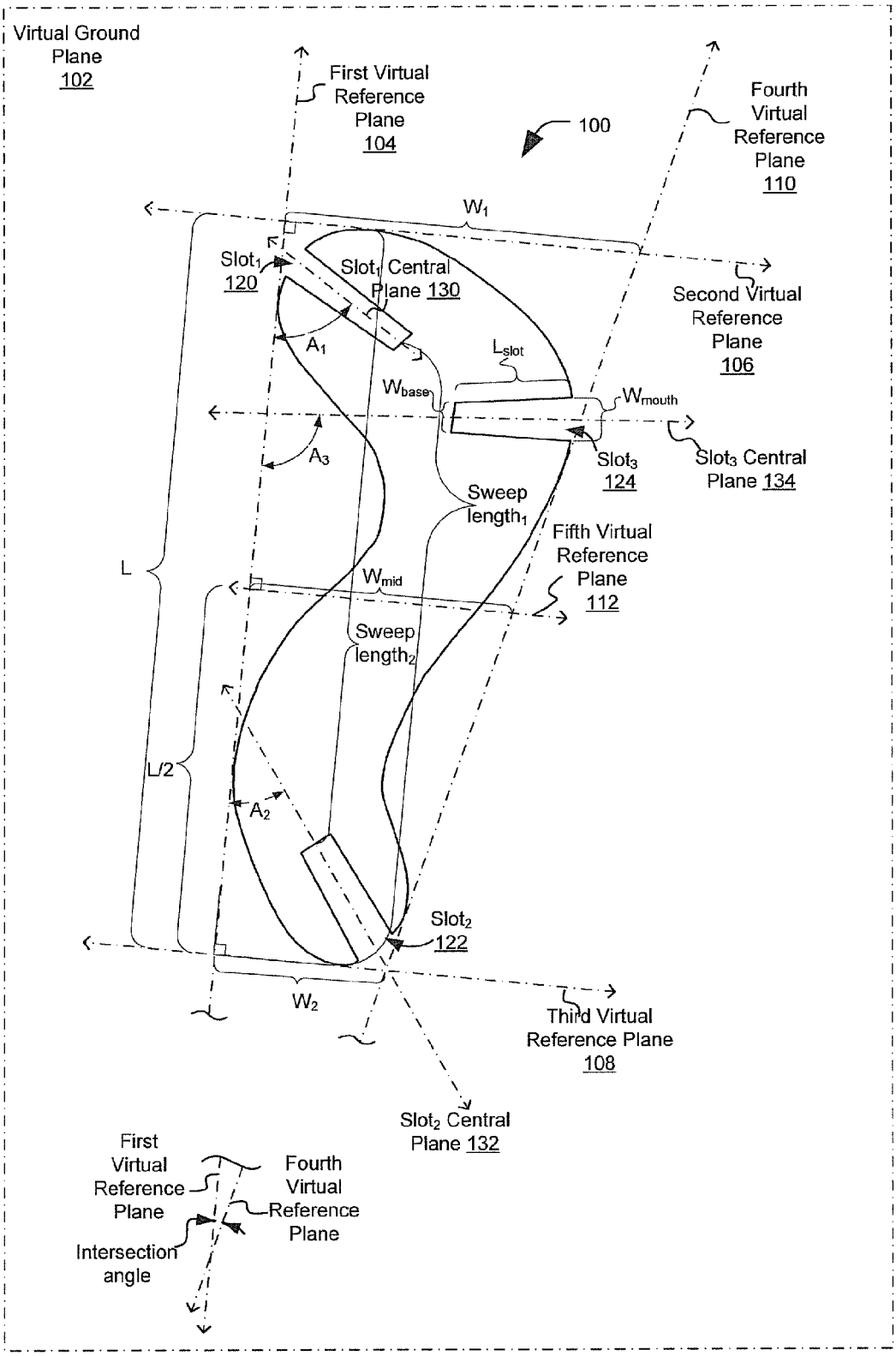
FIG. 1 is a diagram illustrating a first particular embodiment of a wrench.

FIG. 1 is a diagram illustrating a first particular embodiment of a wrench, generally designated 100. The wrench 100 has an S-shaped body including a first end and a second end. A first slot 120 is proximate the first end, and a second slot 122 is proximate the second end. In some embodiments, the wrench 100 also includes a third slot 124. The wrench 100 is generally intended for use with hand-tightened fasteners. Accordingly, the wrench 100 may be formed of a relatively inexpensive, easily workable material, such as a polymer, a relatively soft metal (e.g., aluminum) or another material. Alternatively, when the wrench 100 is for use with other fasteners, the wrench 100 may be formed of a harder or tougher material in order to withstand larger forces that may be encountered during usage. Alternately, or in addition, the material used to form the wrench may be treated to harden the material and/or to increase wear tolerance (e.g., using a heat treatment process).

In a particular example, the S-shaped body of the wrench 100 has two faces that are planar or substantially planar (e.g., generally flat within manufacturing error). In FIG. 1, the wrench 100 is illustrated as lying on a virtual ground plane 102 (coincident with or parallel to the drawing sheet) with a first face of the wrench 100 facing the virtual ground plane 102 and a second face of the wrench 100 facing away from the virtual ground plane 102 (e.g. visible in the drawing).

Several other virtual reference planes are illustrated in FIG. 1 to facilitate understanding of features of the wrench 100. For example, the other virtual reference planes provide convenient reference points to describe dimensions and proportions of the wrench 100. Each of the other virtual reference planes is perpendicular to the virtual ground plane 102. A first virtual reference plane 104 abuts the S-shaped body of the wrench 100 at a first point and a second point on a first side of the S-shaped body. The first point and the second point may be between the first slot and the second slot (e.g., not crossing a mouth of either slot). A second virtual reference plane 106 is perpendicular to the first virtual reference plane 104 and abuts the S-shaped body of the wrench 100 at a third point proximate the first end. A third virtual reference plane 108 is perpendicular to the first virtual reference plane 104 and abuts the S-shaped body of the wrench 100 at a fourth point proximate the second end. A fourth virtual reference plane 110 abuts the S-shaped body of the wrench 100 at a fifth point and a sixth point on a second side of the S-shaped body. The fifth point and the sixth point may be between the first slot and the second slot (e.g., not crossing a mouth of either slot). The second side of the wrench 100 is opposite the first side of the wrench 100. A fifth virtual reference plane 112 is perpendicular to the first virtual reference plane 104 and to the virtual ground plane 102 and is positioned midway between the second virtual reference plane 106 and the third virtual reference plane 108 along the first virtual reference plane 104.

In a particular example, the first slot 120 is of substantially equal size and shape to the second slot 122. When the third slot 124 is present, the third slot 124 may also be the same size and shape as the first and second slots 120, 122. A length of each slot 120, 122, 124 may be larger than a largest width of each slot. For example, the largest width of each slot may be at a mouth end of the slot, and a narrowest width of each slot may be at a base end of the slot. The length of each slot may be at least twice the largest width of the slot (e.g., may be at least twice the width of the mouth end). Thus, the slots may be tapered from the mouth end to the base end. The wider mouth end may facilitate receiving a head of a fastener into the slot when the fastener and the wrench 100 are not visible to the user. Additionally, tapering the slots 120, 122, 124 may enable the wrench 100 to be used with fasteners having heads of different sizes. In a particular embodiment, walls of the slots 120, 122, 124 are substantially perpendicular (e.g., within acceptable manufacturing tolerance) to the virtual ground plane 102.

In FIG. 1, a central plane of each slot is illustrated. For example, the first slot 120 is illustrated as having a first central plane 130, the second slot 122 is illustrated as having a second central plane 132, and the third slot 124 is illustrated as having a third central plane 134. The central plane 130, 132, 134 of each slot 120, 122, 124 is a virtual reference plane that is perpendicular to the virtual ground plane 102 and corresponds to a center of the slot 120, 122, 124. For example, the central plane 130, 132, 134 of each slot 120, 122, 124 may include (e.g., pass through) a midpoint of a projection of the largest width of the slot on the virtual ground plane 102 and a midpoint of a projection of the smallest width of the slot on the virtual ground plane 102. To illustrate, when the third slot 124 has a width at the mouth end, $W_{mouth}$, and a width at the base end, $W_{base}$, the central plane 134 of the third slot 124 may include a center point of $W_{mouth}$ and a center point of $W_{base}$.

In a particular example, each of the central planes 130, 132, 134 intersects the first virtual reference plane 104 at other than a right angle (i.e., an angle that is not 90 degrees). To illustrate, the central plane 130 of the first slot 120 intersects the first virtual reference plane 104 at a first angle, $A_1$, the central plane 132 of the second slot 122 intersects the first virtual reference plane 104 at a second angle, $A_2$, and the central plane 134 of the third slot 124 intersects the first virtual reference plane 104 at a third angle, $A_3$. The angles $A_1$, $A_2$ and $A_3$ may each be greater than zero degrees and less than 90 degrees or greater than 90 degrees and less than 180 degrees. Asymmetric placement of the slots 120, 122, 124 as well as the angles $A_1$, $A_2$ and $A_3$ of the slots 120, 122, 124 may enable the wrench 100 to be flipped end-over-end or side-over-side to provide a variety of wrench 100 configurations to approach a head of a fastener. In a particular embodiment, the asymmetric placement of the slots 120, 122, 124 and the angles $A_1$, $A_2$ and $A_3$ of the slots 120, 122, 124 enable a full 360 degree rotation of the head of the fastener when as little as 45 degrees of swing are permitted by surroundings of the fastener.

In a particular example, the S-shaped body of the wrench 100 curves continuously with no straight portions other than the slots 120, 122, 124. The continuously curving S-shaped body may improve user comfort while using the wrench 100, because the curves may fit more naturally in the user's hand. Additionally, the curves may help the user locate the slots 120, 122, 124 readily when the wrench 100 is being used in an area that is not visible to the user. For example, the body of the wrench 100 may be pressed (at any point) against the head of the fastener and the curves may be followed to one of the slots 120, 122, 124. In contrast, conventional wrenches with straight lengths (e.g., box end wrenches) have jaws that project away from the straight lengths near each opening.

Such protruding jaws provide a discontinuous approach to the opening of these wrenches, which may be difficult for the user to follow while pressing the wrench against the head of the fastener, making working with such wrenches more difficult when the user is not able to see the wrench.

In various examples, the wrench 100 has dimensions and proportions that facilitate use of the wrench 100 in cramped work environments and from a variety of angles or clocking positions. For example, an aspect ratio of the wrench 100 may be relatively small. The aspect ratio may be an indication of "stubbiness" of the wrench 100. For example, the aspect ratio may be determined as a ratio of a characteristic length of the wrench 100 to a characteristic width of the wrench 100. A low aspect ratio wrench may be easier to use in confined areas, e.g., in areas with limited clearance. For example, a low aspect ratio of a wrench may indicate that the characteristic length and the characteristic width of the wrench are similar. When long lever arms are not needed (e.g., to apply large torques to the fastener) the low aspect ratio can (depending on obstructions within the area of use) provide increased throw or displacement of the wrench. To illustrate, to turn through a particular angular displacement, a wrench sweeps through an area that corresponds to a length of the wrench and the angle displaced. Thus, a longer wrench sweeps through a larger area to turn through the particular angular displacement than a shorter wrench does. Width of the wrench 100 may be constrained in order to provide features such as asymmetric arrangement of the slots 120, 122, 124, smooth, continuous curves, and tapered openings of the slots 120, 122, 124. The wrench 100 has a relatively low aspect ratio in order to provide reduced sweep area in combination with other features of the wrench 100, such as asymmetric arrangement of the slots 120, 122, 124 on the S-shaped body.

In a particular example, the aspect ratio of the wrench 100 may be defined by a first dimension of the wrench 100 that corresponds to a shortest distance between the second virtual reference plane 106 and the third virtual reference plane 108 (i.e., a length, L), and a second dimension of the wrench 100 that corresponds to a distance between the first virtual reference plane 104 and the fourth virtual reference plane 110 measured along the fifth virtual reference plane 112 (e.g., a middle line width, $W_{mid}$). In a particular embodiment, the aspect ratio of the wrench 100 (e.g., the first dimension divided by the second dimension) has a value that is less than 3. For example, in the embodiment illustrated in FIG. 1, the wrench 100 has an aspect ratio of about 2.7. In other embodiments, the wrench 100 may have an aspect ratio between about 2.5 and about 3.0.

As another example of a useful proportion, the S-shaped body of the wrench 100 may be asymmetric end-to-end. Asymmetry end-to-end may be indicated by a difference in a width at one end as compared to a width at the other end. Asymmetry end-to-end may increase a number of distinct approaches to the head of the fastener that can be achieved (i.e., a number of different physical configurations of the wrench 100 and the head of the fastener). To illustrate, as a result of the end-to-end asymmetry, a sweep length of the wrench 100 may be different depending on whether the head of the fastener is engaged by the first slot 120 or the second slot 122. As a specific example, using the embodiment illustrated in FIG. 1, from the base of the first slot 120 to the second end (measured parallel to the first virtual reference plane 104) is a first sweep length (sweep $length_1$) and from the base of the second slot 122 to the first end (measured parallel to the first virtual reference plane 104) is a second sweep length (sweep $length_2$). Because of the end-to-end asymmetry of the wrench 100 in the embodiment of FIG. 1, the first sweep length is larger than the second sweep length.

A measure of end-to-end asymmetry may be indicated by a ratio of widths of the wrench at each end. For example, a third dimension of the wrench 100 may correspond to a distance, $W_1$, along the second virtual reference plane 106 between the first virtual reference plane 104 and the fourth virtual reference plane 110, and a fourth dimension of the wrench 100 corresponds to a distance, $W_2$, along the third virtual reference plane 108 between the first virtual reference plane 104 and the fourth virtual reference plane 110. In the embodiment illustrated in FIG. 1, the third dimension is larger than the fourth dimension. In a particular embodiment, a ratio of the third dimension divided by the fourth dimension is greater than less than 1.7. In other embodiments, the ratio of the third dimension divided by the fourth dimension may be greater than about 1.4 or greater than about 1.5.

Another measure that may be used to indicate end-to-end asymmetry is an intersection angle of the first virtual reference plane 104 and the fourth virtual reference plane 110. In the embodiment illustrated in FIG. 1, the intersection angle of the first virtual reference plane 104 and the fourth virtual reference plane 110 is greater than 10 degrees. In other embodiments, the intersection angle may be greater than 9 degrees or greater than 8 degrees. Note that the intersection angle is distinct from the ratio of the widths because the intersection angle is also related to length of the wrench 100. That is, assuming the same end widths, a longer wrench will have a smaller intersection angle and a shorter (or stubbier) wrench will have a larger intersection angle. Thus, a large intersection angle may be associated with a stubby wrench that has significant end-to-end asymmetry.

As yet another example of a useful proportion, the S-shaped body of the wrench 100 may have a ratio of a perimeter of the wrench to openings of the slots that is relatively small. Reduced perimeter is associated with increased "roundness". For example, a circular wrench would have a smaller perimeter for a particular sweep length than a square or rectangular wrench with the same sweep length. To illustrate, compare a square wrench with a particular sweep length to a circular wrench with the same sweep length, assuming an equal depth of the slot between the square wrench and the circular wrench. The sweep length of the circular wrench may correspond to a diameter, d, of the circle (minus a depth of the slot). The sweep length of the square wrench may correspond to a length of a side, s, of the wrench (minus the depth of the slot). The circular wrench has a perimeter of pi times the diameter, d, and the square wrench has a perimeter of 4 times length of a side, s. Since the wrenches have equal sweep lengths, d is equal to s. Thus, a small perimeter may be associated with increased roundness of the wrench.

The perimeter of the wrench 100 is interrupted at each slot; however, the slots are small to accommodate relatively small fastener heads. Thus, in the embodiment illustrated in FIG. 1, a ratio of the perimeter of the wrench 100 (corresponding to a projection of the S-shaped body on the virtual ground plane 102) divided by a sum of the largest widths of the slots may be greater than 10 or greater than 11. For purposes of determining the ratio, at each slot, the perimeter may be measured across a mouth of the slot. To illustrate, in the embodiment illustrated in FIG. 1, the ratio of the perimeter of the wrench 100 divided by the sum of the largest widths of the slots is about 15. In other embodiments, the ratio of the perimeter of the wrench 100 divided by the sum of the largest widths of the slots may be between about 10 and about 20.

Thus, the wrench 100 provides improved ease of use, especially when used in confined areas. The wrench 100 may enable tightening and/or loosing of hand-tightened fasteners, such as hose clamps that feature a thumb screw type worm drive. The wrench 100 has a compact profile that facilitates use in limited access areas where such hose clamps are often used, and where general purpose tools, such as pliers, are difficult to use. Additionally, the tapered slots provide "one-size-fits-all" flexibility to use the wrench 100 with fasteners with different sized heads. The asymmetry of the slots and the asymmetry of the S-shaped body accommodate tightening or loosening of fasteners in different clocking positions and with various access limitations. The S-shaped body may be fabricated of inexpensive materials, such as aluminum (2024 T3), for endurance and strength. The wrench 100 may be particular useful to satisfy torque requirements that are specified using a finger-tight plus (x) turns format because the asymmetric body enables the user to keep up with how many turns have been made.

Figure 2:
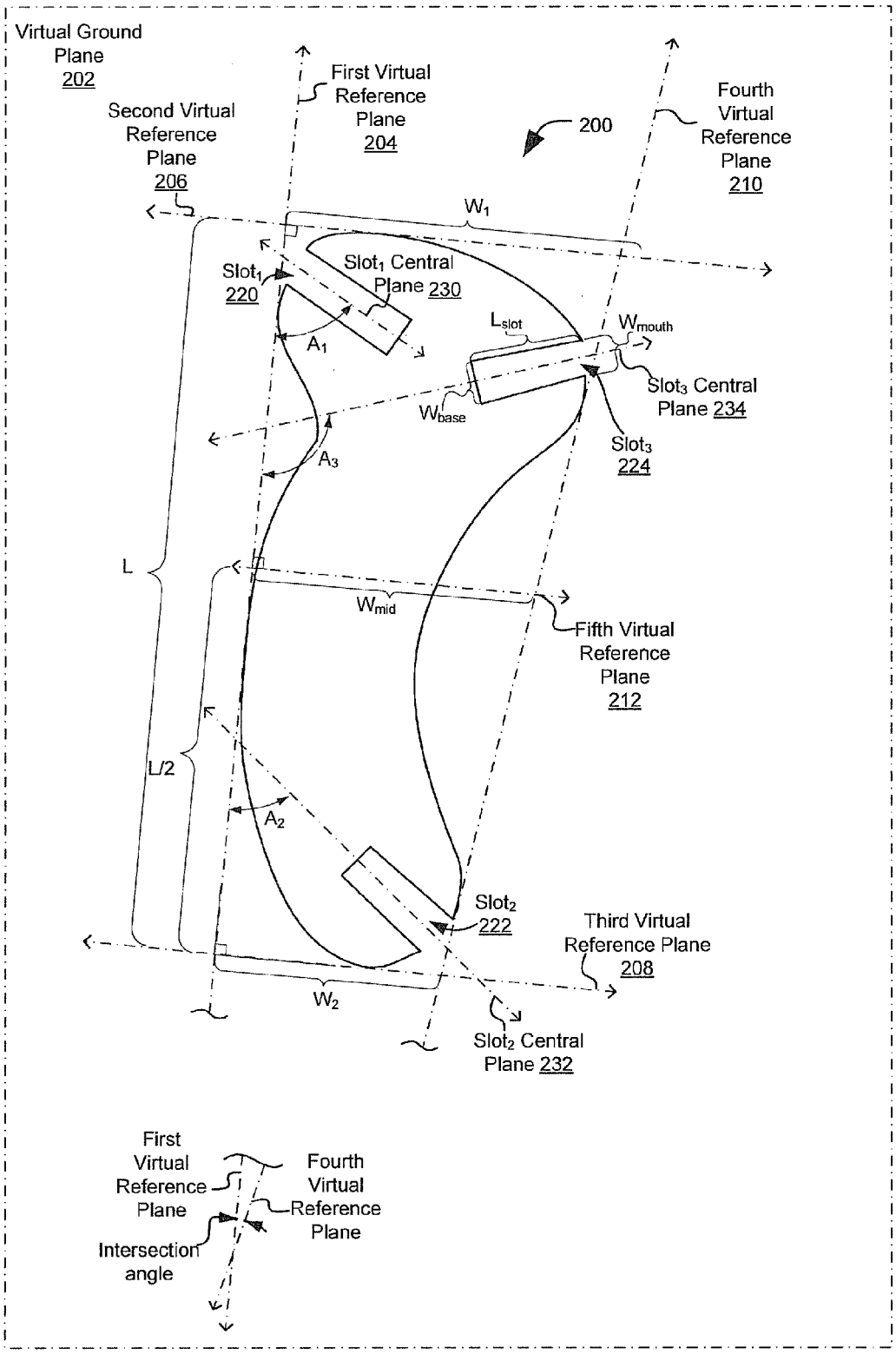
FIG. 2 is a diagram illustrating a second particular embodiment of a wrench.

FIG. 2 is a diagram illustrating a second particular embodiment of wrench, generally designated 200. The wrench 200 has an S-shaped body including a first end and a second end. A first slot 220 is proximate the first end, and a second slot 222 is proximate the second end. In some embodiments, the wrench 200 also includes a third slot 224. The wrench 200 is generally intended for use with hand-tightened fasteners. Accordingly, the wrench 200 may be formed of a relatively inexpensive, easily workable material, such as a polymer, a relatively soft metal (e.g., aluminum) or another material. Alternatively, when the wrench 200 is for use with other fasteners, the wrench 200 may be formed of a harder or tougher material in order to withstand larger forces that may be encountered during usage. Alternately, or in addition, the material used to form the wrench may be treated to harden the material and/or to increase wear tolerance (e.g., using a heat treatment process).

In a particular example, the S-shaped body of the wrench 200 has two faces that are planar or substantially planar (e.g., generally flat within manufacturing error). In FIG. 2, the wrench 200 is illustrated as lying on a virtual ground plane 202 (coincident with or parallel to the drawing sheet) with a first face of the wrench 200 facing the virtual ground plane 202 and a second face of the wrench 200 facing away from the virtual ground plane 202 (e.g. visible in the drawing).

Several other virtual reference planes are illustrated in FIG. 2 to facilitate understanding of features of the wrench 200. The other virtual reference planes are defined in the same manner as the virtual reference planes 104-112 of FIG. 1. For example, a first virtual reference plane 204 is perpendicular to the virtual ground plane 202 and abuts the S-shaped body of the wrench 200 at a first point and a second point on a first side of the S-shaped body. The first point and the second point may be between the first slot and the second slot (e.g., not crossing a mouth of either slot). A second virtual reference plane 206 is perpendicular to the virtual ground plane 202 and to the first virtual reference plane 204 and abuts the S-shaped body of the wrench 200 at a third point proximate the first end. A third virtual reference plane 208 is perpendicular to the virtual ground plane 202 and to the first virtual reference plane 204 and abuts the S-shaped body of the wrench 200 at a fourth point proximate the second end. A fourth virtual reference plane 210 is perpendicular to the virtual ground plane 202 and abuts the S-shaped body of the wrench 200 at a fifth point and a sixth point on a second side of the S-shaped body. The fifth point and the sixth point may be between the first slot and the second slot (e.g., not crossing a mouth of either slot). The second side of the wrench 200 is opposite the first side of the wrench 200. A fifth virtual reference plane 212 is perpendicular to the virtual ground plane 202 and to the first virtual reference plane 204 and is positioned midway between the second virtual reference plane 206 and the third virtual reference plane 208 along the first virtual reference plane 204.

In a particular example, the first slot 220 is of substantially equal size and shape to the second slot 222. When the third slot 224 is present, the third slot 224 may also be the same size and shape as the first and second slots 220, 222. A length of each slot 220, 222, 224 may be larger than a largest width of each slot. For example, the largest width of each slot may be at a mouth end of the slot, and a narrowest width of each slot may be at a base end of the slot. The length of each slot may be at least twice the largest width of the slot (e.g., may be at least twice the width of the mouth end). Thus, the slots may be tapered from the mouth end to the base end. The wider mouth end may facilitate receiving a head of a fastener into the slot when the fastener and the wrench 200 are not visible to the user. Additionally, tapering the slots 220, 222, 224 may enable the wrench 200 to be used with fasteners with heads of different sizes. In a particular embodiment, walls of the slots 220, 222, 224 are substantially perpendicular (e.g., within acceptable manufacturing tolerance) to the virtual ground plane 202.

In FIG. 2, a central plane of each slot is illustrated. For example, the first slot 220 is illustrated as having a first central plane 230, the second slot 222 is illustrated as having a second central plane 232, and the third slot 224 is illustrated as having a third central plane 234. The central plane 230, 232, 234 of each slot 220, 222, 224 is a virtual reference plane that is perpendicular to the virtual ground plane 202 and corresponds roughly to a center of the slot 220, 222, 224. For example, the central plane 230, 232, 234 of each slot 220, 222, 224 may include (e.g., pass through) a midpoint of a projection of the largest width of the slot on the virtual ground plane 202 and a midpoint of a projection of the smallest width of the slot on the virtual ground plane 202. To illustrate, when the third slot 224 has a width at the mouth end, $W_{mouth}$, and a width at the base end, $W_{base}$, the central plane 234 of the third slot 224 may include a center point of $W_{mouth}$ and a center point of $W_{base}$.

In a particular example, each of the central planes 230, 232, 234 intersects the first virtual reference plane 204 at a non-right angle (i.e., an angle other than 90 degrees). To illustrate, the central plane 230 of the first slot 220 intersects the first virtual reference plane 204 at a first angle, $A_1$, the central plane 232 of the second slot 222 intersects the first virtual reference plane 204 at a second angle, $A_2$, and the central plane 234 of the third slot 224 intersects the first virtual reference plane 204 at a third angle, $A_3$. The angles $A_1$, $A_2$ and $A_3$ may each be greater than zero degrees and less than 90 degrees or greater than 90 degrees and less than 180 degrees. Asymmetric placement of the slots 220, 222, 224 as well as the angles $A_1$, $A_2$ and $A_3$ of the slots 220, 222, 224 may enable the wrench 200 to be flipped end-over-end or side-over-side to provide a variety of wrench 200 configurations to approach a head of a fastener. In a particular embodiment, the asymmetric placement of the slots 220, 222, 224 and the angles $A_1$, $A_2$ and $A_3$ of the slots 220, 222, 224 enable a full 360 degree rotation of the head of the fastener when as little as 45 degrees of swing are permitted by surroundings of the fastener.

In a particular example, the S-shaped body of the wrench 200 curves continuously with no straight lengths other than the slots 220, 222, 224. The continuously curving S-shaped body improves user comfort while using the wrench 200 and may help the user locate the slots 220, 222, 224 when the wrench 200 is being used in an area that is not visible to the user. For example, the body of the wrench 200 may be pressed (at any point) against the head of the fastener and the curves may be followed to one of the slots 220, 222, 224.

In various examples, the wrench 200 has dimensions and proportions that facilitate use of the wrench 200 in cramped work environments and from a variety of angles or clocking positions. For example, an aspect ratio of the wrench 200 may be about 2.6 (i.e., less than 3 or between about 2.5 and about 3.0). As described above, the aspect ratio may be determined as a ratio of a characteristic length of the wrench 200 to a characteristic width of the wrench 200. To illustrate, the aspect ratio of the wrench 200 may be defined by a first dimension of the wrench 200 that corresponds to a shortest distance between the second virtual reference plane 206 and the third virtual reference plane 208 (i.e., a length, L), and a second dimension of the wrench 200 that corresponds to a distance between the first virtual reference plane 204 and the fourth virtual reference plane 210 measured along the fifth virtual reference plane 212 (e.g., a middle line width, $W_{mid}$).

As another example of a useful proportion, the S-shaped body of the wrench 200 may be asymmetric end-to-end. For example, a first measure of end-to-end asymmetry may be indicated by a ratio of widths of the wrench 200 at each end. For example, a third dimension of the wrench 200 may correspond to a distance, $W_1$, along the second virtual reference plane 206 between the first virtual reference plane 204 and the fourth virtual reference plane 210, and a fourth dimension of the wrench 200 corresponds to a distance, $W_2$, along the third virtual reference plane 208 between the first virtual reference plane 204 and the fourth virtual reference plane 210. In the embodiment illustrated in FIG. 2, the third dimension is larger than the fourth dimension and a ratio of the third dimension divided by the fourth dimension is about 1.5.

A second measure indicative of end-to-end asymmetry is intersection angle of the first virtual reference plane 204 and the fourth virtual reference plane 210. In the embodiment illustrated in FIG. 2, the intersection angle of the first virtual reference plane 204 and the fourth virtual reference plane 210 is about 9 degrees.

As yet another example of a useful proportion, in the embodiment illustrated in FIG. 2, a ratio of the perimeter of the wrench 200 (corresponding to a projection of the S-shaped body on the virtual ground plane 202) divided by a sum of the largest widths of the slots is about 14 (i.e., greater than 11). For purposes of determining the ratio, at each slot, the perimeter may be measured across a mouth of the slot.

Thus, the wrench 200 provides improved ease of use, especially when used in confined areas. The wrench 200 may enable tightening and/or loosing of hand-tightened fasteners, such as hose clamps that feature a thumb screw type worm drive. The wrench 200 has a compact profile that facilitates use in limited access areas where such hose clamps are often used, and where general purpose tools, such as pliers, are difficult to use. Additionally, the tapered slots provide "one-size-fits-all" flexibility to use the wrench 200 with fasteners with different sized heads. The asymmetry of the slots and the asymmetry of the S-shaped body accommodate tightening or loosening of fasteners in different clocking positions and with various access limitations. The S-shaped body may be fabricated of inexpensive materials, such as aluminum (2024 T3), for endurance and strength. The wrench 200 may be particular useful to satisfy torque requirements that are specified using a finger-tight plus (x) turns format since the asymmetric body enables the user to keep up with how many turns have been made.

Figure 3:
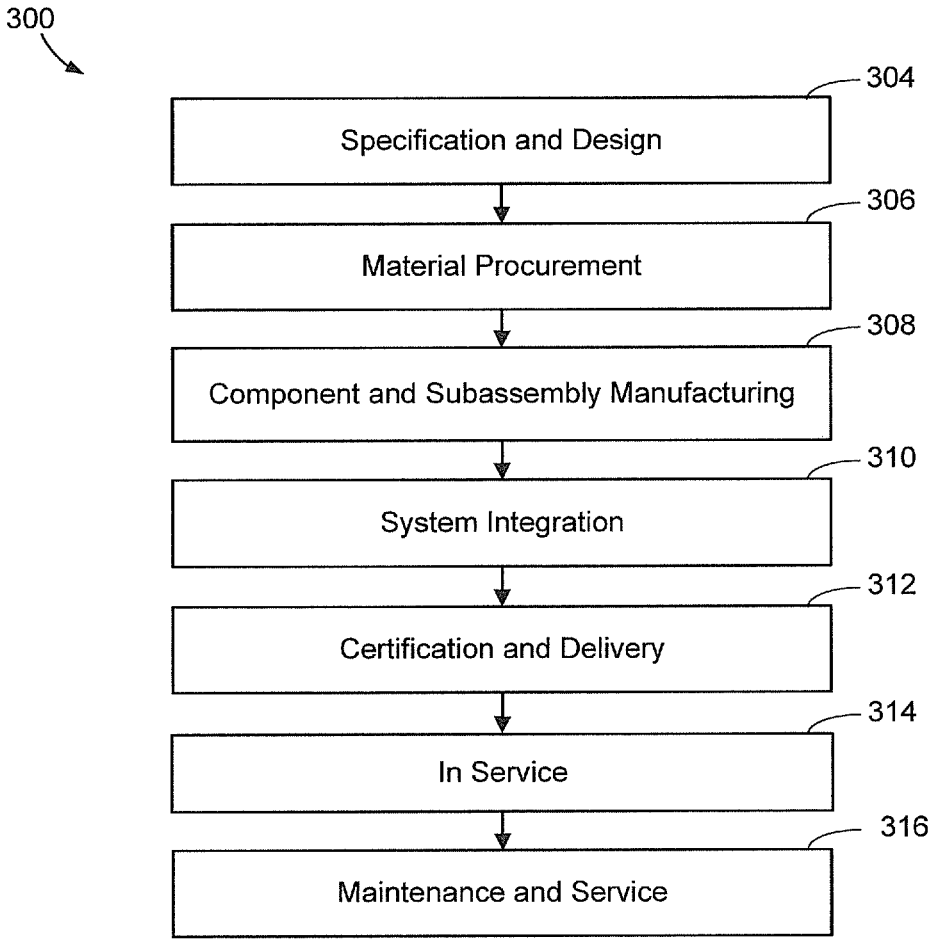
FIG. 3 is a flow diagram of aircraft production and service methodology.
Figure 4:
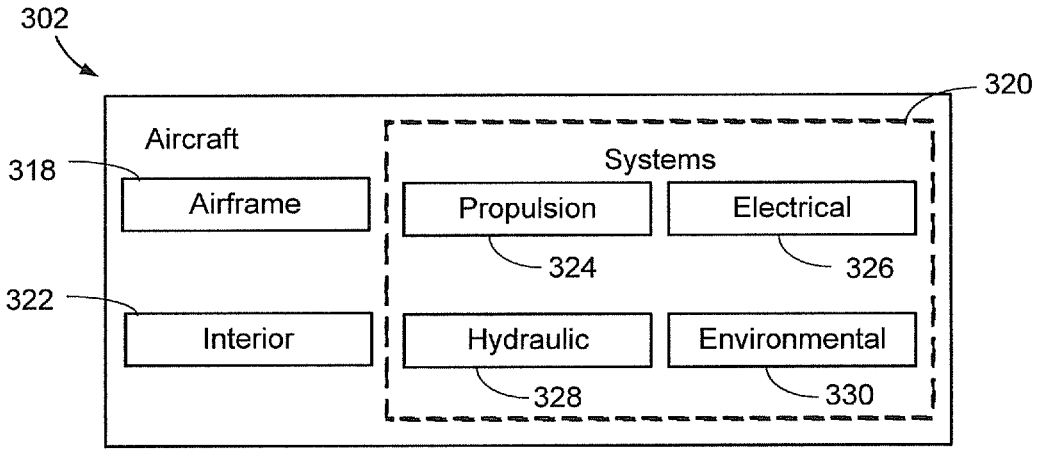
FIG. 4 is a block diagram of an aircraft.

Referring more particularly to the drawings, examples of the disclosure may be described in the context of an aircraft manufacturing and service method 300 as shown in FIG. 3 and an aircraft 302 as shown in FIG. 4. During pre-production, exemplary method 300 may include specification and design 304 of the aircraft 302 and material procurement 306. During production, component and subassembly manufacturing 308 and system integration 310 of the aircraft 302 takes place. Thereafter, the aircraft 302 may go through certification and delivery 312 in order to be placed in service 314. While in service by a customer, the aircraft 302 may be scheduled for routine maintenance and service 316 (which may also include modification, reconfiguration, refurbishment, and so on).

Each of the processes of method 300 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on. In a particular embodiment, one or more of the processes of the method 300 may be performed using the wrench 100 or the wrench 200. For example, a thumb screw type worm drive hose clamp may be installed or removed during component and subassembly manufacturing 308, during system integration 310, during certification and delivery 312, in service 314, or during maintenance and service 316 using the wrench 100 or the wrench 200.

As shown in FIG. 4, the aircraft 302 produced by exemplary method 300 may include an airframe 318 with a plurality of systems 320 and an interior 322. Examples of high-level systems 320 include one or more of a propulsion system 324, an electrical system 326, a hydraulic system 328, and an environmental system 330. Any number of other systems may be included. Although an aerospace example is shown, the principles of the disclosure may be applied to other industries, such as the automotive industry.

Apparatus and methods embodied herein may be employed during any one or more of the stages of the production and service method 300. For example, components or subassemblies corresponding to a production process may be fabricated or manufactured in a manner similar to components or subassemblies produced while the aircraft 302 is in service. Also, one or more apparatus embodiments, method embodiments, or a combination thereof may be utilized during the production stages (e.g., the component subassembly manufacturing stage 308 and the system integration stage 310), for example, by substantially expediting assembly of or reducing the cost of an aircraft 302. Similarly, one or more of apparatus embodiments, method embodiments, or a combination thereof may be utilized while the aircraft 302 is in service, for example and without limitation, to maintenance and service 316.

Examples described above illustrate but do not limit the disclosure. It should also be understood that numerous modifications and variations are possible in accordance with the principles of the present disclosure. Accordingly, the scope of the disclosure is defined only by the following claims.

The illustrations of the examples described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. For example, method steps may be performed in a different order than is shown in the figures or one or more method steps may be omitted. Accordingly, the disclosure and the figures are to be regarded as illustrative rather than restrictive.

Moreover, although specific examples have been illustrated and described herein, it should be appreciated that any subsequent arrangement designed to achieve the same or similar results may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is submitted with the understanding that it will not be used to interpret or limit the scope or meaning of the claims. In addition, in the foregoing Detailed Description, various features may be grouped together or described in a single embodiment for the purpose of streamlining the disclosure. As the following claims reflect, the claimed subject matter may be directed to less than all of the features of any of the disclosed examples.

What is claimed is:

1. A wrench comprising:

an S-shaped body including a first end, a second end, a first slot proximate the first end, a second slot proximate the second end, and a third slot, wherein each of the first slot and the second slot has a particular length, a particular largest width, and a particular smallest width, the particular length larger than the particular largest width, and the S-shaped body is shaped such that:

a reference ground plane is substantially perpendicular to walls of the first slot and the second slot of the S-shaped body;

a first reference plane is perpendicular to the reference ground plane and abuts the S-shaped body at a first point and a second point on a first side of the S-shaped body, wherein the first point and the second point are between the first slot and the second slot;

a second reference plane is perpendicular to the first reference plane and to the reference ground plane and abuts the S-shaped body at a third point proximate the first end;

a third reference plane is perpendicular to the first reference plane and to the reference ground plane and abuts the S-shaped body at a fourth point proximate the second end; and a fourth reference plane is perpendicular to the reference ground plane and abuts the S-shaped body at a fifth point and a sixth point on a second side of the S-shaped body opposite the first side, wherein the fifth point and the sixth point are between the first slot and the second slot, and wherein the third slot is on the second side of the S-shaped body.

2. The wrench of claim 1, wherein a first dimension of the wrench corresponds to a shortest distance between the second reference plane and the third reference plane, a second dimension of the wrench corresponds to a distance between the first reference plane and the fourth reference plane measured along a fifth reference plane that is perpendicular to the first reference plane and to the reference ground plane and intersects the first reference plane midway between the second reference plane and the third reference plane, and the first dimension divided by the second dimension is a value less than 3.

3. The wrench of claim 1, wherein a third dimension of the wrench corresponds to a first distance along the second reference plane between the first reference plane and the fourth reference plane and a fourth dimension of the wrench corresponds to a second distance along the third reference plane between the first reference plane and the fourth reference plane, and the third dimension divided by the fourth dimension is a value greater than 1.7.

4. The wrench of claim 1, wherein an intersection angle of the first reference plane and the fourth reference plane is greater than 10 degrees.

5. The wrench of claim 1, wherein the particular largest width is at a mouth end of each of the first slot and the second slot and the particular smallest width is at a base end of each of the first slot and the second slot.

6. The wrench of claim 1, wherein each of the particular lengths is at least twice the corresponding particular largest width.

7. The wrench of claim 1, wherein the S-shaped body curves continuously with no straight portions other than the walls of the first slot and the second slot.

8. The wrench of claim 1, wherein a ratio of a perimeter of a projection of the S-shaped body onto the reference ground plane to a sum of the particular largest widths of the first slot, the second slot, and the third slot is greater than 11.

9. The wrench of claim 8, wherein, at each of the first slot, the second slot, and the third slot, the perimeter is measured across a mouth thereof.

10. The wrench of claim 1, wherein the S-shaped body has two faces that are substantially planar.

11. The wrench of claim 1, wherein the S-shaped body is formed of aluminum.

12. A wrench comprising:

an S-shaped body including a first end, a second end, a first slot proximate the first end, and a second slot proximate the second end, wherein a first size and a first shape of the first slot and a second size and a second shape of the second slot are substantially the same, the shape of each of the first slot and the second slot has a particular largest width at a first mouth and particular smallest width at a base thereof, and the S-shaped body is shaped such that:

a reference ground plane is substantially perpendicular to walls of the first slot and the second slot of the S-shaped body;

a first reference plane is perpendicular to the reference ground plane and abuts the S-shaped body at a first point and a second point on a first side of the S-shaped body, the first point and the second point between the first slot and the second slot;

a second reference plane is perpendicular to the first reference plane and to the reference ground plane and abuts the S-shaped body at a third point proximate the first end;

a third reference plane is perpendicular to the first reference plane and to the reference ground plane and abuts the S-shaped body at a fourth point proximate the second end;

a fourth reference plane is perpendicular to the reference ground plane and abuts the S-shaped body at a fifth point and a sixth point on a second side of the S-shaped body, the fifth point and the sixth point between the first slot and the second slot, wherein the second side is opposite the first side;

a first dimension of the wrench corresponds to a shortest distance between the second reference plane and the third reference plane;

a second dimension of the wrench corresponds to a first distance between the first reference plane and the fourth reference plane measured along a fifth reference plane that is perpendicular to the first reference plane and to the reference ground plane and intersects the first reference plane midway between the second reference plane and the third reference plane; and a first ratio of the first dimension to the second dimension is less than 3.

13. The wrench of claim 12, wherein a particular length of each of the first slot and the second slot is at least twice the corresponding particular largest width of each of the first slot and the second slot.

14. The wrench of claim 13, wherein a central plane of each of the first slot is a sixth reference plane that is perpendicular to the reference ground plane and includes a first midpoint of a first projection of the particular largest width on the reference ground plane and a second midpoint of a second projection of the particular smallest width on the reference ground plane, wherein the central plane intersects the first reference plane at an angle that is not 90 degrees.

15. The wrench of claim 14, further including a third slot on the second side of the S-shaped body, a second ratio of a perimeter of a third projection of the S-shaped body onto the reference ground plane to a sum of the particular largest widths of the first slot, the second slot, and the third slot being greater than 11, wherein the perimeter is measured across mouths of the first slot, the second slot and the third slot.

16. The wrench of claim 15, wherein a third dimension of the wrench corresponds to a second distance along the second reference plane between the first reference plane and the fourth reference plane and a fourth dimension of the wrench corresponds to a third distance along the third reference plane between the first reference plane and the fourth reference plane, and a third ratio of the third dimension to the fourth dimension is greater than 1.7.

17. The wrench of claim 16, wherein an intersection angle of the first reference plane and the fourth reference plane is greater than 10 degrees.

18. The wrench of claim 17, wherein the S-shaped body has two faces that are substantially planar.

19. A wrench comprising:

an S-shaped body including a first end, a second end, a first slot proximate the first end, a second slot proximate the second end, and a third slot on a side of the S-shaped body between the first end and the second end, wherein the S-shaped body is shaped such that:

a reference ground plane is substantially perpendicular to walls of the first slot, the second slot, and the third slot; and a ratio of a perimeter of a projection of the S-shaped body onto the reference ground plane to a sum of largest widths of the first slot, the second slot, and the third slot is greater than 11, wherein, at each of the first slot, the second slot, and the third slot, the perimeter is measured across a mouth thereof.

20. The wrench of claim 19, wherein a first size and a first shape of the first slot, a second size and a second shape of the second slot, and a third size and a third shape of the third slot are substantially the same and each of the first slot, the second slot, and the third slot has a particular largest width, a particular smallest width, and a particular length that is larger than the particular largest width.

* * * * *